US009188905B2

(12) United States Patent
Nagata

(10) Patent No.: US 9,188,905 B2
(45) Date of Patent: Nov. 17, 2015

(54) IMAGE FORMING APPARATUS, IMAGE FORMING METHOD, AND NON-TRANSITORY COMPUTER READABLE MEDIUM USING A TONER SUPPLYING UNIT

(71) Applicant: FUJI XEROX CO., LTD., Tokyo (JP)

(72) Inventor: Kenjo Nagata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/581,550

(22) Filed: Dec. 23, 2014

(65) Prior Publication Data

US 2015/0261132 A1 Sep. 17, 2015

(30) Foreign Application Priority Data

Mar. 13, 2014 (JP) ..... 2014-049662

(51) Int. Cl.
*G03G 15/08* (2006.01)

(52) U.S. Cl.
CPC ..... *G03G 15/0868* (2013.01)

(58) Field of Classification Search
CPC ..... G03G 15/0856; G03G 15/0865; G03G 15/0867; G03G 15/0868; G03G 15/0877; G03G 15/556; G03G 2215/0695
USPC ..... 399/12, 27
See application file for complete search history.

(56) References Cited

U.S. PATENT DOCUMENTS

| | | | | |
|---|---|---|---|---|
| 8,249,469 | B2 * | 8/2012 | Sakamoto et al. | 399/27 |
| 8,472,819 | B2 * | 6/2013 | Chaplin et al. | 399/27 |
| 8,666,264 | B2 * | 3/2014 | Shimazu et al. | 399/12 |
| 8,787,778 | B2 * | 7/2014 | Matsumoto et al. | 399/12 |

FOREIGN PATENT DOCUMENTS

JP 4976064 A 7/2012

* cited by examiner

*Primary Examiner* — William J Royer
(74) *Attorney, Agent, or Firm* — Sughrue Mion, PLLC

(57) ABSTRACT

An image forming apparatus includes a replaceable toner cartridge filled with toner, a toner supplying unit, and a control unit. The toner supplying unit supplies toner from the toner cartridge to a developing device of the apparatus. The control unit exerts control so that, when the toner cartridge is mounted in the apparatus, the toner supplying unit is driven based on the amount of toner with which the mounted toner cartridge is filled in advance. The expression T1>T2 is satisfied, where T1 represents a driving time for the toner supplying unit driven based on the amount of toner with which the toner cartridge mounted upon initial installation is filled in advance, and T2 represents a driving time for the toner supplying unit driven based on the amount of toner with which the toner cartridge mounted newly when no toner is detected is filled in advance.

14 Claims, 7 Drawing Sheets

IMAGE FORMING APPARATUS, IMAGE FORMING METHOD, AND NON-TRANSITORY COMPUTER READABLE MEDIUM USING A TONER SUPPLYING UNIT

CROSS-REFERENCE TO RELATED APPLICATIONS

This application is based on and claims priority under 35 USC 119 from Japanese Patent Application No. 2014-049662 filed Mar. 13, 2014.

BACKGROUND

Technical Field

The present invention relates to an image forming apparatus, an image forming method, and a non-transitory computer readable medium.

SUMMARY

According to an aspect of the invention, there is provided an image forming apparatus including at least one toner cartridge, a toner supplying unit, and a control unit. The at least one toner cartridge is filled with toner and is replaceable. The toner supplying unit supplies the toner from the at least one toner cartridge to a developing device of the image forming apparatus. The control unit exerts control in such a manner that, when the at least one toner cartridge is mounted in the image forming apparatus, the toner supplying unit is driven on the basis of an amount of toner with which the at least one toner cartridge which is mounted is filled in advance. The expression T1>T2 is satisfied, where T1 represents a driving time for the toner supplying unit driven on the basis of the amount of toner with which the at least one toner cartridge which is mounted when the image forming apparatus is initially installed is filled in advance, and T2 represents a driving time for the toner supplying unit driven on the basis of the amount of toner with which the at least one toner cartridge which is newly mounted when no toner is detected in the image forming apparatus is filled in advance.

BRIEF DESCRIPTION OF THE DRAWINGS

An exemplary embodiment of the present invention will be described in detail based on the following figures, wherein.

DETAILED DESCRIPTION

Figure 1:
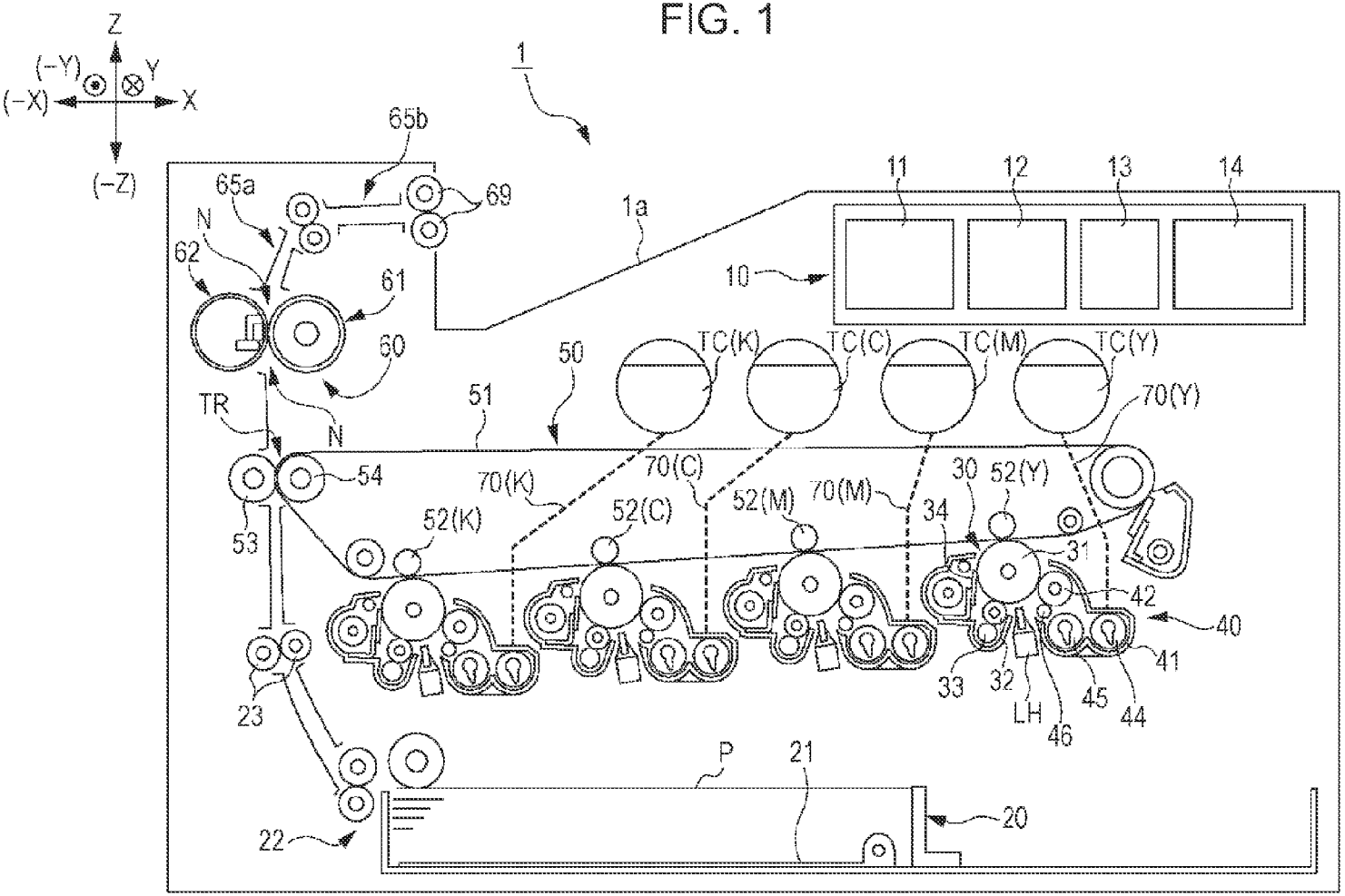
FIG. 1 is a schematic sectional view of an internal configuration of an image forming apparatus.

Referring to the drawings, an exemplary embodiment and a specific example will be described below to provide a further detailed description about the present invention. However, the present invention is not limited to the exemplary embodiment and the specific example.

In description using the drawings which is made below, it should be noted that the drawings are schematic, and that the ratio and the like of a size are different from the real ones. To achieve easy understanding, members which are not necessary for the description are not illustrated as appropriate.

To facilitate understanding of the description, a drawing employs the following representation. The longitudinal direction represents the X axis direction; the transversal direction, the Y axis direction; and the vertical direction, the Z axis direction.

(1) Overall Configuration and Operations of Image Forming Apparatus

FIG. 1 is a schematic sectional view of the internal configuration of an image forming apparatus 1 according to the exemplary embodiment.

Referring to the drawings, the overall configuration and the operations of the image forming apparatus 1 will be described below.

The image forming apparatus 1 includes a control device 10, a sheet feeder 20, photoconductor units 30, developing devices 40, a transfer unit 50, a fixing unit 60, and toner supply devices 70 (70(Y), 70(M), 70(C), and 70(K)). A discharge tray 1*a* on which sheets on which images are recorded are discharged and accommodated is disposed on the top surface of the image forming apparatus 1 (in the Z direction).

The control device 10 includes an image-forming-apparatus controller 11 which controls the operations of the image forming apparatus 1, a controller unit 12 which prepares image data according to a print request, an exposure controller 13 which controls lighting of exposure devices LH, and a power-supply unit 14. The power-supply unit 14 applies a high voltage to charging rollers 32, developing rollers 42, first transfer rollers 52(Y), 52(M), 52(C), and 52(K), a second transfer roller 53, or the like which will be described below, and supplies power, for example, to the exposure devices LH, the sheet feeder 20, the fixing unit 60, and sensors which are provided for the image forming apparatus 1.

The controller unit 12 converts print information received from an external information transmitting apparatus (for example, a personal computer) into image information for forming a latent image, and outputs driving signals to the exposure devices LH at predetermined timings. Each of the exposure devices LH according to the exemplary embodiment is formed with a light emitting diode (LED) head in which multiple LEDs are arrayed in line in the main scanning direction.

The sheet feeder 20 is disposed at the bottom of the image forming apparatus 1. The sheet feeder 20 includes a sheet loading board 21, and many sheets of paper P as recording media are loaded on the top surface of the sheet loading board 21. The sheets of paper P which are loaded on the sheet loading board 21 and which are aligned in the width direction by regulating plates (not illustrated) are pulled to the front side (in the −X direction) by a sheet pulling unit 22 one by one from the top, and are then conveyed to the nip of a registration roller pair 23.

The photoconductor units 30 are aligned in parallel above the sheet feeder 20 (at positions located in the Z direction with respect to the sheet feeder 20), and each of the photoconductor units 30 includes a photoconductor drum 31 serving as an image carrier which is rotated. In the rotation direction of the photoconductor drum 31, a corresponding one of the charging rollers 32, a corresponding one of the exposure devices LH, a corresponding one of the developing devices 40, a corresponding one of the first transfer rollers 52(Y), 52(M), 52(C), or 52(K), and a cleaning blade 34 are disposed. A cleaning roller 33 which cleans the surface of the charging roller 32 is disposed in such a manner as to be opposite and in contact with the charging roller 32.

The developing device 40 includes a development housing 41 which accommodates a developer. In the development housing 41, the developing roller 42 is disposed in such a manner as to be opposite the photoconductor drum 31, and a pair of augers 44 and 45 which agitates the developer and which conveys it to the developing roller 42 is also disposed at an obliquely downward position with respect to the backside of the developing roller 42. A layer regulating member 46 which regulates the layer thickness of the developer is disposed near the developing roller 42.

The developing device 40 is connected to a corresponding one of the toner supply devices 70(Y), 70(M), 70(C), and 70(K), and is supplied with a corresponding type of toner of yellow (Y), magenta (M), cyan (C), and black (K) from a corresponding one of toner cartridges TC(Y), TC(M), TC(C), and TC(K) when necessary. Each of the developing devices 40 has substantially the same configuration except for the developer accommodated in the development housing 41, and forms a toner image of corresponding color of yellow (Y), magenta (M), cyan (C), and black (K).

The charging roller 32 charges the surface of the rotating photoconductor drum 31 on which an electrostatic latent image is formed by using latent-image forming light emitted from the exposure device LH. The electrostatic latent image formed on the photoconductor drum 31 is developed as a toner image by the developing roller 42.

The transfer unit 50 includes an intermediate transfer belt 51 onto which the color toner images formed on the photoconductor drums 31 of the photoconductor units 30 are transferred in a superimposed manner, and the first transfer rollers 52(Y), 52(M), 52(C), and 52(K) which sequentially perform transfer (first transfer) of the color toner images formed by the photoconductor units 30, onto the intermediate transfer belt 51. The transfer unit 50 also includes the second transfer roller 53 which performs collective transfer (second transfer) of the color toner images which have been transferred on the intermediate transfer belt 51 in a superimposed manner, to a sheet of paper P which is a recording medium, and an intermediate-transfer-belt cleaner 54 which removes residual toner attached on the intermediate transfer belt 51.

The color toner images formed on the photoconductor drums 31 of the photoconductor units 30 are sequentially subjected to electrostatic transfer (first transfer) onto the intermediate transfer belt 51 by using the first transfer rollers 52(Y), 52(M), 52(C), and 52(K) to which predetermined transfer voltages are applied by the power-supply unit 14 or the like controlled by the image-forming-apparatus controller 11, forming a superimposed toner image obtained by superimposing the color toner images.

The moving intermediate transfer belt 51 causes the superimposed toner image on the intermediate transfer belt 51 to be conveyed to a region (second transfer unit TR) in which the second transfer roller 53 is disposed. The superimposed toner image is conveyed to the second transfer unit TR, and, at that timing, a sheet of paper P is supplied from the sheet feeder 20 to the second transfer unit TR. The second transfer roller 53 is supplied with a predetermined transfer voltage from the power-supply unit 14 or the like controlled by the image-forming-apparatus controller 11, and the superimposed toner image on the intermediate transfer belt 51 is subjected to collective transfer onto the sheet of paper P which is conveyed by using the registration roller pair 23 and which is guided by a conveying guide.

The residual toner on the surface of the photoconductor drum 31 is removed by the cleaning blade 34, and is recovered into a waste-toner container (not illustrated). The charging roller 32 charges the surface of the photoconductor drum 31 again. A residual material which fails to be removed by the cleaning blade 34 and which is attached to the charging roller 32 is captured onto the surface of the cleaning roller 33 which rotates in such a manner as to be in contact with the charging roller 32, and is accumulated.

The fixing unit 60 includes a heating module 61 and a pressing module 62. A press-contact region between the heating module 61 and the pressing module 62 serves as a fixing nip N (fixing region).

The sheet of paper P on which a toner image which has not been fixed is transferred by the transfer unit 50 is conveyed via the conveying guide to the fixing unit 60. The pair of the heating module 61 and the pressing module 62 causes the toner image on the sheet of paper P conveyed to the fixing unit 60 to be fixed by means of pressing and heating.

The sheet of paper P on which the fixed toner image is formed is guided by conveying guides 65*a* and 65*b*, and is discharged through a discharge roller pair 69 to the discharge tray 1*a* on the top surface of the image forming apparatus 1.

(2) Configuration and Operations of Toner Supply Mechanism

Figure 2:
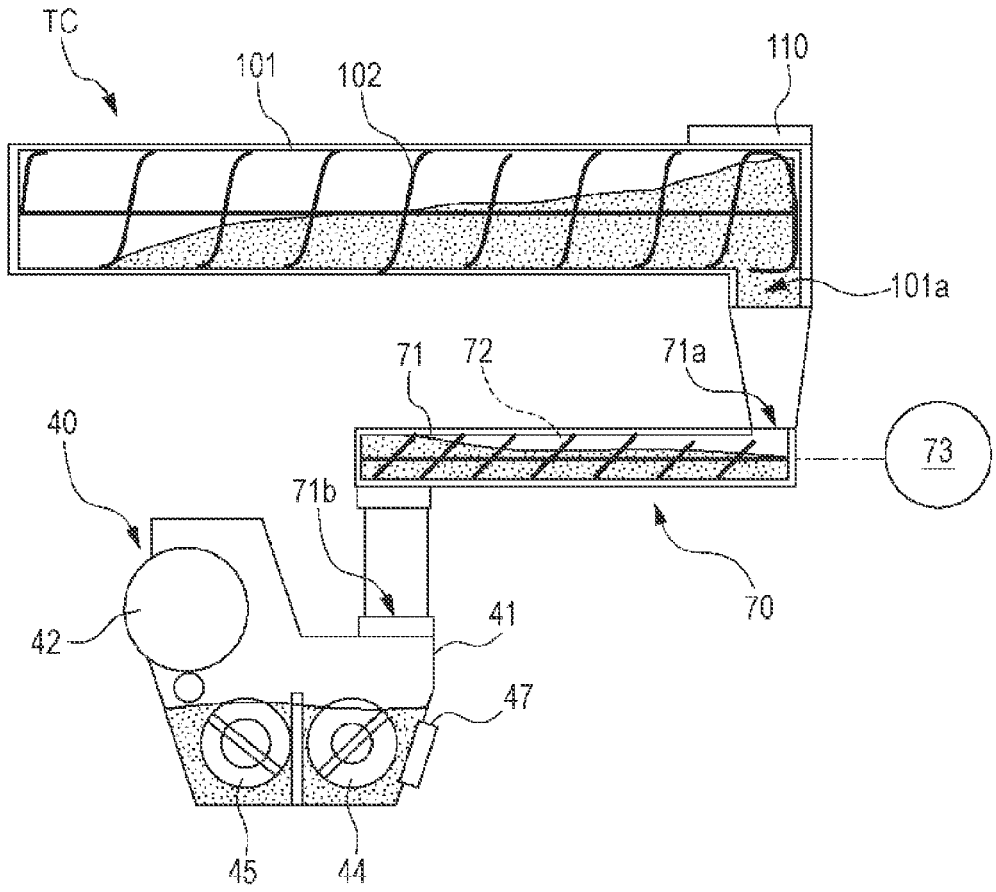
FIG. 2 is a schematic diagram illustrating a connecting configuration between a developing device and a toner supply device.
Figure 3:
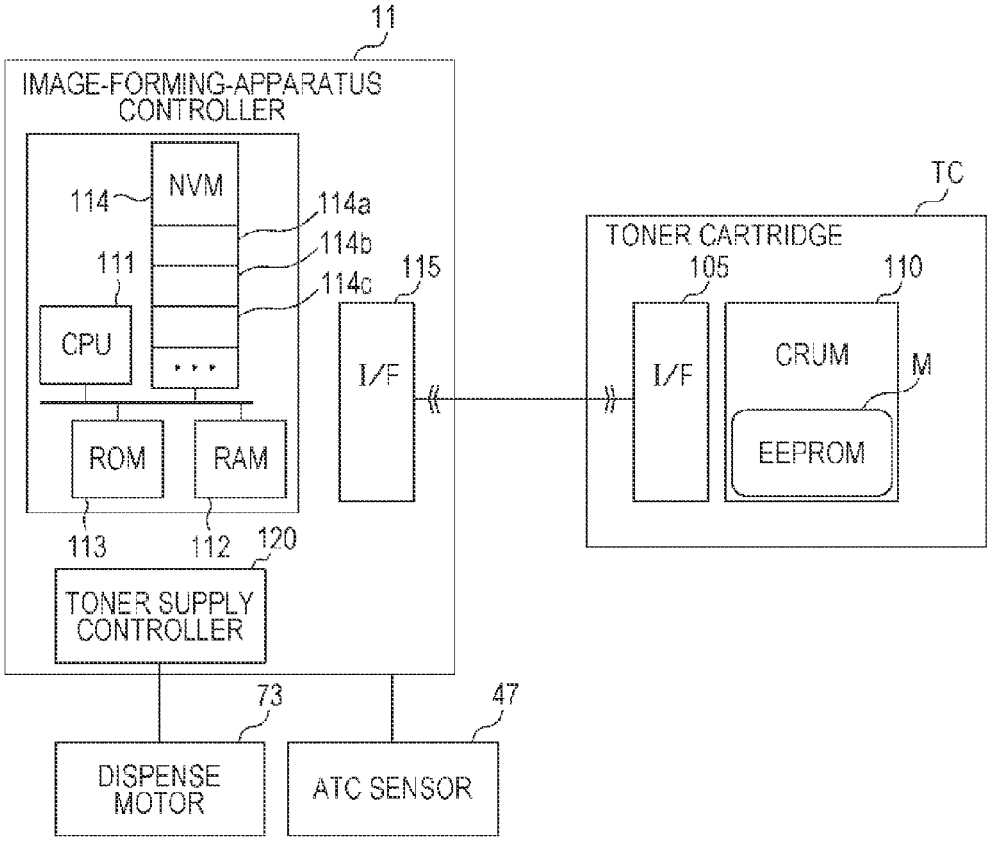
FIG. 3 is a block diagram illustrating the configuration of a toner supply mechanism and exchange of information between a customer replaceable unit memory (CRUM) of a toner cartridge and an image-forming-apparatus controller of the image forming apparatus.
Figure 4:
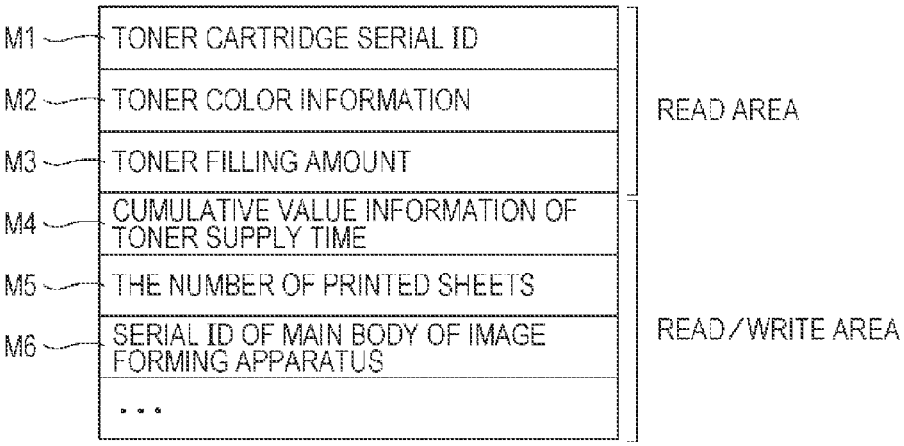
FIG. 4 is a block diagram illustrating a storage area of the CRUM.

FIG. 2 is a schematic diagram illustrating the connecting configuration between a developing device 40 and a toner supply device 70. FIG. 3 is a block diagram illustrating the configuration of a toner supply mechanism and exchange of information between a customer replaceable unit memory (CRUM) 110 of a toner cartridge TC and the image-forming-apparatus controller 11 of the image forming apparatus 1. FIG. 4 is a block diagram illustrating the storage area of the CRUM 110.

Referring to the drawings, the configuration and the operations of the toner supply mechanism will be described.

(2.1) Configuration of Toner Supply Mechanism

As illustrated in FIG. 2, the developing device 40 is connected to a replaceable toner cartridge TC which accommodates toner supplied to the developing device 40, via the toner supply device 70 serving as an exemplary toner supplying unit.

(2.2) Toner Cartridge

The toner cartridge TC includes a housing 101 which accommodates toner, and a coil auger 102 which agitates and conveys the toner contained in the housing 101. When the toner cartridge TC is mounted in the main body of the image forming apparatus 1, rotational driving force is transferred from a driving source (not illustrated) provided for the main body of the image forming apparatus 1 to the coil auger 102.

An opening 101*a* for discharging toner agitated and conveyed by the coil auger 102 is disposed in a bottom portion of the mounting portion onto which the toner cartridge TC is mounted.

The toner cartridge TC includes the CRUM 110 which serves as an exemplary storage unit in which identification information specific to the toner cartridge TC is stored.

The CRUM 110 includes a rewritable nonvolatile memory (EEPROM) M. When the toner cartridge TC is mounted in the main body of the image forming apparatus 1, the CRUM 110 is connected to the image-forming-apparatus controller 11 of the main body of the image forming apparatus 1 in such a manner as to be capable of performing data communication.

The nonvolatile memory (EEPROM) M includes a read area for storing specific information which is read by the image-forming-apparatus controller 11 and a read/write area for storing management information which is read/written by the image-forming-apparatus controller 11.

Examples of the read area include an area M1 for storing the toner cartridge TC serial ID specific to the toner cartridge TC, and an area M2 for storing toner color information. In the exemplary embodiment, the read area further includes an area M3 for storing information about the toner filling amount.

Examples of the read/write area include an area M4 for storing information about a cumulative value information of toner supply time, an area M5 for storing information about the number of printed sheets, and an area M6 for storing the serial ID of the main body of the image forming apparatus 1.

(2.3) Toner Supply Device

The toner supply device 70 which is a mechanism for conveying the toner accommodated in the toner cartridge TC, to the developing device 40 includes a pipe 71 which allows the toner cartridge TC to communicate with the developing device 40, an auger 72 which is contained in the pipe 71 and which conveys the toner, and a dispense motor 73 which rotates the auger 72.

The pipe 71 has a toner inlet port 71*a* for receiving the toner supplied from the toner cartridge TC, on one end, and has a toner supply port 71*b* for supplying the toner conveyed in the pipe 71 by the auger 72 to the developing device 40, on the other end.

(2.4) Developing Device

The developing device 40 includes the development housing 41 which accommodates the developer, the developing roller 42 disposed in such a manner as to be opposite the photoconductor drum 31, and the pair of the augers 44 and 45 which agitates and conveys the developer to the developing roller 42.

The developing device 40 includes an automatic toner-concentration control (ATC) sensor 47 which senses the amount of remaining toner in the development housing 41. The ATC sensor 47 is a magnetic sensor which senses the toner concentration of the developer in the development housing 41 and which outputs the voltage value according to the toner concentration to the image-forming-apparatus controller 11.

(2.5) Operations of Toner Supply Mechanism

The image forming apparatus 1 includes the image-forming-apparatus controller 11 which controls the entirety of the image forming apparatus 1. The image-forming-apparatus controller 11 which is a circuit board on which a central processing unit (CPU) 111, a random access memory (RAM) 112, a read only member (ROM) 113, and the like are mounted includes a toner supply controller 120 which serves as an exemplary control unit.

The toner supply controller 120 controls the toner supply device 70 in accordance with the toner consumption of the developing device 40, and controls toner supply from the toner cartridge TC to the developing device 40.

Specifically, the toner supply controller 120 controls rotation of the dispense motor 73 on the basis of the toner concentration (the amount of remaining toner) in the development housing 41 which is sensed by the ATC sensor 47.

When the toner cartridge TC is mounted in the main body of the image forming apparatus 1, an interface (I/F) 105 of the toner cartridge TC is connected to an interface (I/F) 115 of the image-forming-apparatus controller 11 so as to be capable of communicating with the interface 115. In FIG. 3, the image-forming-apparatus controller 11 performs wired communication with the CRUM 110, but may perform wireless communication with the CRUM 110.

The CPU 111 of the image-forming-apparatus controller 11 enables the information in the CRUM 110 to be read or rewritten. The CPU 111 which is connected to the RAM 112, the ROM 113, a nonvolatile memory (NVM) 114, and the interface 115 reads programs for controlling the operations of the image forming apparatus 1 from the ROM 113, and reads and rewrites the information in the RAM 112 and the NVM 114.

The NVM 114 of the image-forming-apparatus controller 11 contains an area 114*a* for storing various types of setting information for image formation, and an area 114*b* for storing the serial ID of the main body of the image forming apparatus 1.

The NVM 114 also contains an area 114*c* for storing driving time information for the dispense motor 73 corresponding to the specific information of the CRUM 110.

(3) Toner Supply Operation

In the image forming apparatus 1 including the toner supply mechanism having this configuration, no toner is present in the pipes 71 of the toner supply devices 70 when the image forming apparatus 1 is shipped from a factory, whereby leakage of toner from connections or the like of the toner supply devices 70 during transport is avoided.

In initial installation of the image forming apparatus 1 which is performed by a user, after the toner cartridges TC are mounted, the toner supply devices 70 are rotationally driven, and toner is supplied from the mounted toner cartridges TC via the pipes 71 of the toner supply devices 70 into the developing devices 40.

As toner cartridges TC to be used, multiple types of toner cartridges TC having different amounts of toner (hereinafter referred to as initial filling amounts) with which the housings 101 are filled in advance are prepared in accordance with the use condition of the image forming apparatus 1.

For toner cartridges TC having the multiple types of toner amount, a standardized housing 101 may be prepared and mounted from the viewpoint of widespread use of the toner cartridges TC serving as consumables which are replaced and used. It is rational for the housing 101 mounted in the main body of the image forming apparatus 1 to have a common internal space capacity (toner filling capacity).

When a new toner cartridge TC is mounted on the main body of the image forming apparatus 1, the image-forming-apparatus controller 11 obtains identification information which is specific to the toner cartridge TC and which is stored in the CRUM 110.

The toner supply device 70 is rotationally driven by the toner supply controller 120, and toner is supplied to the developing device 40. A different toner amount with which the housing 101 is filled in advance produces a different condition in agitation and conveyance of toner in the housing 101 which are made by the coil auger 102, whereby the actual amount of toner supplied via the pipe 71 of the toner supply device 70 to the developing device 40 may be changed.

Specifically, the larger the volume of toner with respect to the internal space capacity of the housing 101 of the toner cartridge TC is, the higher the conveyance efficiency of the toner is. The smaller the volume of toner with respect to the internal space capacity of the housing 101 of the toner cartridge TC is, the lower the conveyance efficiency of the toner is.

Therefore, when the toner supply controller 120 drives the dispense motor 73 for the same time period with a toner cartridge TC having a different amount of toner with which the toner cartridge TC is filled in advance, the amount of conveyed toner is larger in the former case.

As a result, when the toner supply controller 120 performs the toner supply operation for a predetermined driving time, a change, such as an excessive supply amount or an insufficient supply amount, may be produced in accordance with the magnitude of the toner amount accommodated in advance in the toner cartridge TC.

(3.1) Toner Supply Operation Upon Initial Installation

Figure 5:
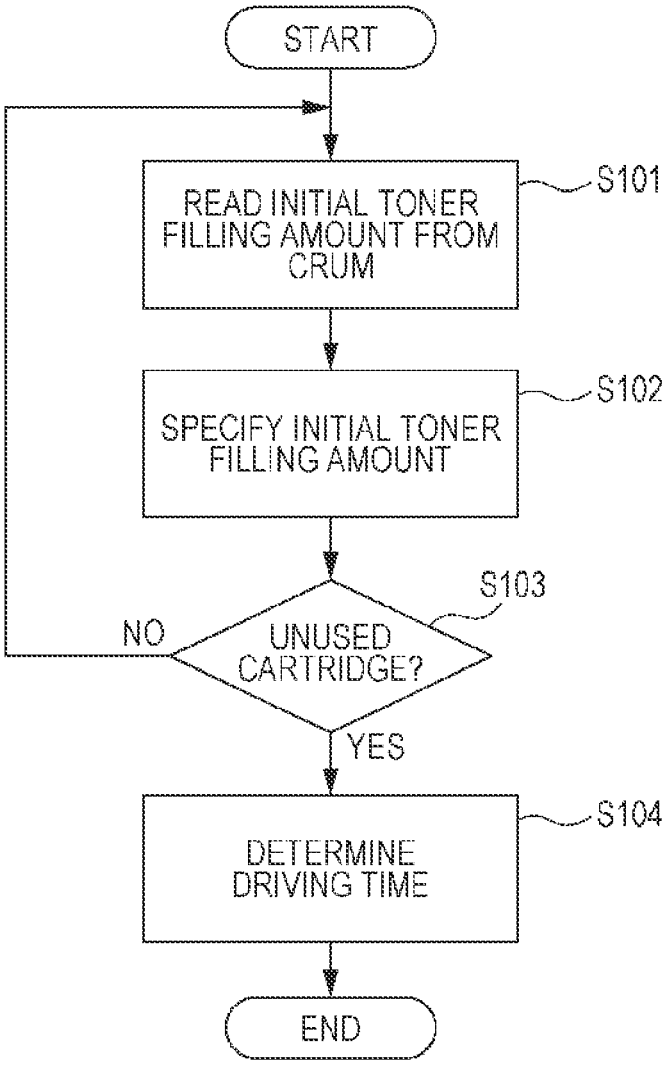
FIG. 5 is a flowchart of a toner supply operation performed by the image forming apparatus upon initial installation.

FIG. 5 is a flowchart of a toner supply operation performed by the image forming apparatus 1 upon initial installation. With reference to the flowchart in FIG. 5, the toner supply operation performed by the image forming apparatus 1 upon initial installation will be described below.

When a toner cartridge TC is mounted upon initial installation of the image forming apparatus 1 according to the exemplary embodiment, the image forming apparatus 1 obtains information about the toner filling amount from the nonvolatile memory (EEPROM) M in the CRUM 110 of the mounted toner cartridge TC. A driving time T1 for the dispense motor 73 of the toner supply device 70 is determined on the basis of the toner filling amount obtained by the toner supply controller 120.

When the toner cartridge TC is mounted, the image-forming-apparatus controller 11 reads information about the toner filling amount from the nonvolatile memory (EEPROM) M of the CRUM 110 provided for the toner cartridge TC (S101).

The image-forming-apparatus controller 11 specifies the initial toner filling amount of the toner cartridge TC on the basis of the information which is read in step S101 (S102).

The image-forming-apparatus controller 11 determines whether or not the toner cartridge TC which is mounted and detected is an unused cartridge (S103). The determination is made with reference to information about a cumulative value of toner supply time which is obtained from the nonvolatile memory (EEPROM) M.

If the toner cartridge TC is determined to be an unused cartridge in step S103 (YES in S103), the image-forming-apparatus controller 11 reads the driving time T1 for the dispense motor 73 corresponding to the detected toner cartridge TC from the area 114*c* for storing the driving time information for the dispense motor 73 corresponding to the specific information of the CRUM 110 in the NVM 114, and determines the control value of the toner supply controller 120 (S104).

Specifically, assume that the initial toner filling amount of the toner cartridge TC mounted upon initial installation is 50% (the toner cartridge TC is filled up to 50% of the refillable internal space capacity in the housing 101 of the toner cartridge TC). In this case, the driving time T1 for the dispense motor 73 is determined by adding a correction time t to a reference time TA which is a driving time for the dispense motor 73 used when the toner cartridge TC whose initial toner filling amount is 100% (the toner cartridge TC is filled up to 100% of the refillable internal space capacity in the housing 101 of the toner cartridge TC) is mounted.

The correction time t is determined in accordance with the initial toner filling amount of the toner cartridge TC. For example, initial filling amounts are classified into classifications of a value less than 25%, a value equal to or larger than 25% and less than 50%, a value equal to or larger than 50% and less than 75%, and a value equal to or larger than 75%, and correction times t1, t2, and t3 may be determined on the basis of the respective classifications. A value equal to or larger than 75% is regarded as a value of 100%, and the correction time is not added.

Therefore, even in the case where multiple types of toner cartridges TC having different initial filling amounts are prepared and used when the image forming apparatus 1 is initially installed, the driving time T1 for the dispense motor 73 is corrected in accordance with the conveyance efficiency of toner contained in each of the toner cartridges TC. Therefore, occurrence of a change, such as an excessive supply amount or an insufficient supply amount, according to the magnitude of the toner filling amount accommodated in the toner cartridge TC may be suppressed.

(3.2) Toner Supply Operation upon Detection of No Toner

Figure 6:
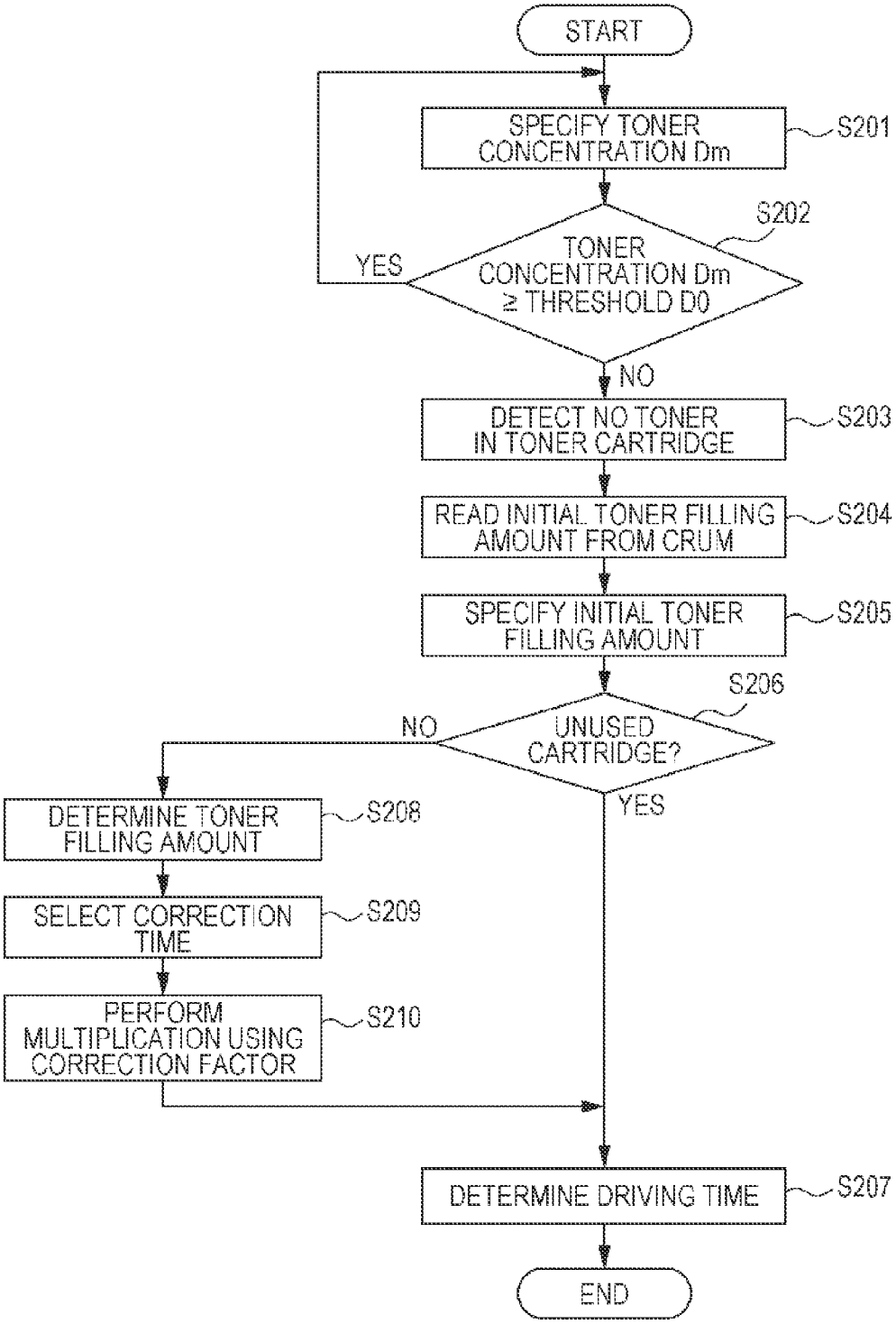
FIG. 6 is a flowchart of a toner supply operation performed by the image forming apparatus when no toner is detected.

FIG. 6 is a flowchart of a toner supply operation performed by the image forming apparatus 1 when no toner is detected. With reference to the flowchart in FIG. 6, the toner supply operation performed by the image forming apparatus 1 when no toner is detected will be described below.

A toner cartridge TC mounted in the image forming apparatus 1 is used, and, when no toner is detected, information about the toner filling amount is obtained from the nonvolatile memory (EEPROM) M in the CRUM 110 of a toner cartridge TC which is newly mounted. A driving time T2 for the dispense motor 73 of the toner supply device 70 is determined on the basis of the toner filling amount obtained by the toner supply controller 120.

The image-forming-apparatus controller 11 senses a permeability in the developing device 40 by using the ATC sensor 47, and specifies a toner concentration Dm of the developer accommodated in the developing device 40 on the basis of the sensing result (S201).

It is determined whether or not the toner concentration Dm specified in step S201 is equal to or larger than a predetermined threshold DO (S202). If the specified toner concentration Dm is determined to be less than the threshold DO (NO in S202), no toner in the toner cartridge TC is detected (S203).

After no toner is detected, when a new toner cartridge TC is mounted, the image-forming-apparatus controller 11 reads information about the toner filling amount from the nonvolatile memory (EEPROM) M of the CRUM 110 provided for the toner cartridge TC (S204).

The image-forming-apparatus controller 11 specifies the toner filling amount of the toner cartridge TC on the basis of the information which is read in step S204 (S205).

The image-forming-apparatus controller 11 determines whether or not the toner cartridge TC which is mounted and detected is an unused cartridge (S206). The determination is made with reference to information about a cumulative value of toner supply time which is obtained from the nonvolatile memory (EEPROM) M.

If the toner cartridge TC is determined to be an unused cartridge in step S206 (YES in S206), the image-forming-apparatus controller 11 reads the driving time T2 for the dispense motor 73 corresponding to the detected toner cartridge TC from the area 114*c* for storing the driving time information for the dispense motor 73 corresponding to the specific information of the CRUM 110 in the NVM 114, and determines the control value of the toner supply controller 120 (S207).

Specifically, assume that the initial toner filling amount of the newly mounted toner cartridge TC is 50%. In this case, the driving time T2 for the dispense motor 73 is determined by adding the correction time t1 to a reference time TB which is a driving time for the dispense motor 73 used when the toner cartridge TC whose initial toner filling amount is 100% is mounted.

When a new toner cartridge TC is mounted after detection of no toner, the toner cartridge TC which was mounted before was already used. Therefore, a certain amount of toner from the toner cartridges TC which were used before remains on the internal surface of the pipe 71 of the toner supply device 70.

Therefore, the reference time TB used when no toner is detected is set so as to satisfy the expression TB<TA which is defined relative to the reference time TA used upon initial installation. As a result, even when toner cartridges TC having the same initial filling amount are used, the driving time T2 for the dispense motor 73 used when no toner is detected is made shorter, suppressing occurrence of a fog and a cloud due to an increase in the toner concentration of the developer which is caused by an excessive toner supply amount.

If the toner cartridge TC is determined not to be an unused cartridge in step S206 (NO in S206), the image-forming-apparatus controller 11 refers to information about a cumulative value of toner supply time which is obtained from the nonvolatile memory (EEPROM) M, and estimates the toner filling amount (remaining amount) of the newly mounted toner cartridge TC (S208).

The correction time corresponding to a classification for initial filling amounts, which is obtained through classification of toner filling amounts and to which the estimated toner filling amount (remaining amount) belongs, is selected (S209). A correction time is determined by multiplying the selected correction time by a correction factor predetermined for a used toner cartridge TC (S210).

Toner of an unused toner cartridge TC is often accommodated in the housing 101 in an unbalanced state due to transport, storage, or the like. In contrast, in a toner cartridge TC which was used once, the coil auger 102 conveyed toner in the housing 101 to the opening 101*a*. Therefore, high conveyance efficiency is presumed. Accordingly, the correction factor is set at a value smaller than 1.

That is, a driving time T3 for the dispense motor 73 used when the toner cartridge TC which is newly mounted upon detection of no toner is not unused is determined by adding the reference time TB to a correction time determined by multiplying a correction factor smaller than 1 by the correction time t.

As a result, the driving times for the toner supply device 70 used when the image forming apparatus 1 is initially installed and when no toner in a toner cartridge TC is detected are determined as appropriate in such a manner that the expression T1>T2>T3 is satisfied, where T1 is a driving time determined on the basis of the initial toner filling amount of a toner cartridge TC mounted upon initial installation, T2 is a driving time determined on the basis of the initial toner filling amount of a toner cartridge TC which is newly mounted upon detection of no toner, and T3 is a driving time determined on the basis of the toner filling amount (remaining amount) of a used toner cartridge TC which is newly mounted upon detection of no toner.

Therefore, occurrence of a fog and a cloud due to an excessive supply amount of toner from a toner cartridge TC is suppressed. On the other hand, occurrence of a decrease in the concentration due to an insufficient toner supply amount is suppressed.

(3.3) Toner Supply Operation During Image Formation

A toner cartridge TC mounted in the image forming apparatus 1 is used, and, when image formation is performed, the toner supply time required for the toner supply device 70 is determined on the basis of the toner concentration Dm, which is specified by the ATC sensor 47, of the developer accommodated in the developing device 40.

Figure 7:
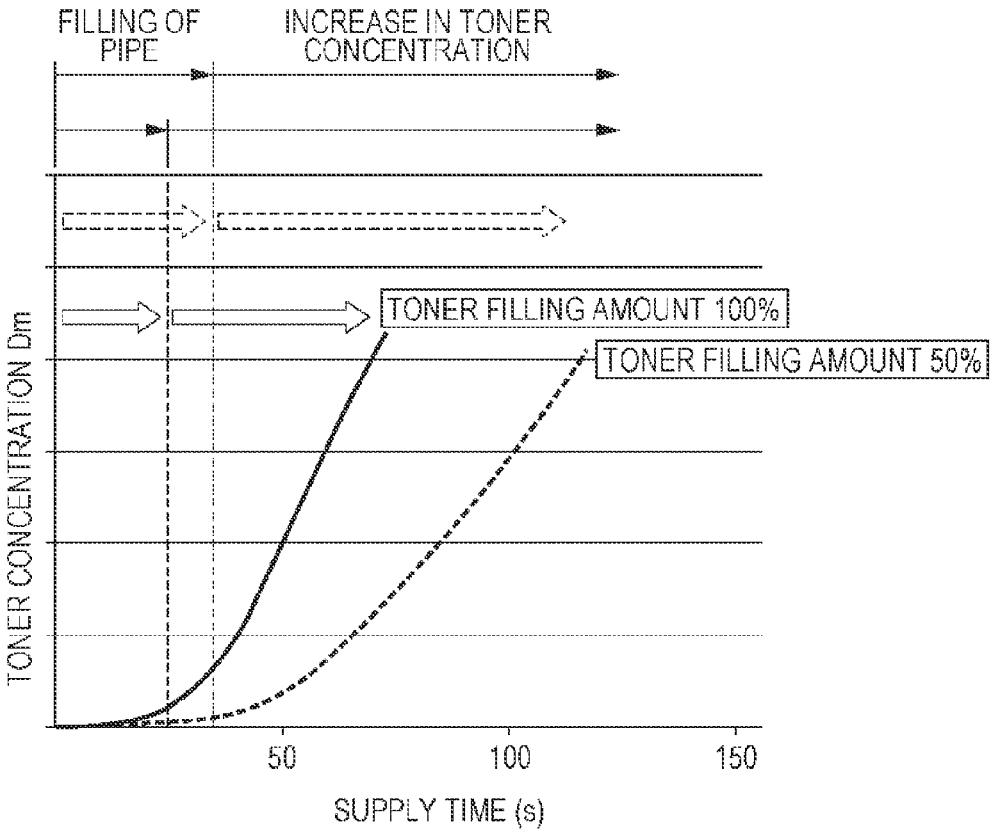
FIG. 7 is a schematic diagram illustrating the relationship between an increase in toner concentration of a developer in a developing device and a toner supply time, for the initial toner filling amount in a toner cartridge.

FIG. 7 is a schematic diagram illustrating the relationship between the toner supply time and an increase in the toner concentration of the developer in the developing device 40, for the initial toner filling amount of a toner cartridge TC.

As illustrated in FIG. 7 schematically, the toner filling speed in the pipe 71 of the toner supply device 70 and an increase rate of the toner concentration of the developer in the developing device 40 after the pipe 71 is filled with toner supplied from the toner cartridge TC depend on the initial toner filling amount of a toner cartridge TC.

The reason for this is presumed as follows. The conveyance efficiency of toner produced by the coil auger 102 in the housing 101 depends on the initial toner filling amount of a toner cartridge TC. Therefore, when the initial toner filling amount is small, a longer time is required to accumulate toner sufficiently around the opening 101*a* of the housing 101 compared with a toner cartridge TC whose initial toner filling amount is large.

Figure 8:
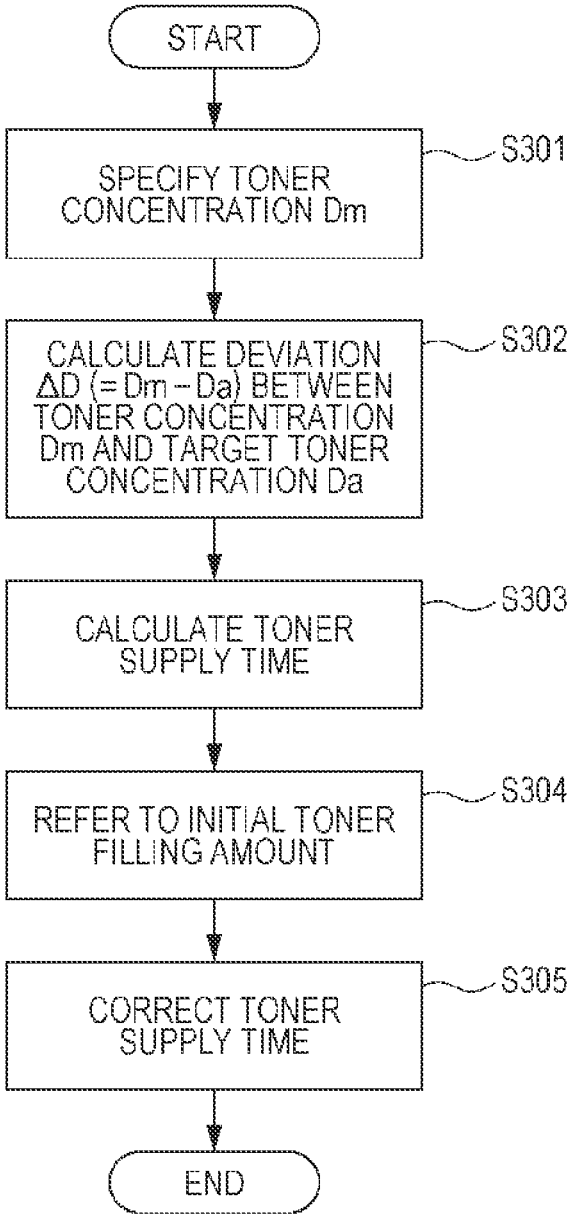
FIG. 8 is a flowchart of a toner supply operation performed by the image forming apparatus during image formation.

FIG. 8 is a flowchart of a toner supply operation performed by the image forming apparatus 1 during image formation. With reference to the flowchart in FIG. 8, the toner supply operation performed by the image forming apparatus 1 during image formation will be described below.

The image forming apparatus 1 according to the exemplary embodiment corrects the toner supply time which is required for a toner supply device 70 on the basis of the toner concentration Dm of the developer, on the basis of the initial toner filling amount of the toner cartridge TC.

The image-forming-apparatus controller 11 senses a permeability in the developing device 40 by using the ATC sensor 47, and specifies the toner concentration Dm of the developer accommodated in the developing device 40 on the basis of the sensing result (S301).

A deviation ΔD between the toner concentration Dm specified in step S301 and a target toner concentration Da which is a toner concentration to be obtained is calculated (S302), and a toner supply time is calculated on the basis of the calculated deviation ΔD (S303).

The image-forming-apparatus controller 11 refers to the initial toner filling amount which is obtained from the nonvolatile memory (EEPROM) M in the CRUM 110 of the current toner cartridge TC and which is stored (S304), and corrects the toner supply time by multiplying the toner supply time calculated in step S303 by a correction coefficient (S305).

That is, for a toner cartridge TC having a different initial toner filling amount, the toner supply controller 120 corrects the toner supply time required for the toner supply device 70 on the basis of the initial toner filling amount of the toner cartridge TC.

Specifically, an increased toner supply time required for a toner cartridge TC whose initial toner filling amount is not 100% causes the increase rate of the toner concentration in the developer to be increased, suppressing a decrease in concentration during image formation.

The exemplary embodiment of the present invention is described in detail. However, the present invention is not limited to the above-described exemplary embodiment. Various changes may be made within the gist of the present invention which is described in the scope of claims.

For example, in the exemplary embodiment, information about the toner filling amount is obtained from the nonvolatile memory (EEPROM) M in the CRUM 110 of the mounted toner cartridge TC, and the driving time T1 for the toner supply device 70 is determined on the basis of the toner filling amount obtained by the toner supply controller 120. In the case where the toner cartridge TC does not include the CRUM 110, when the initial toner filling amount of a toner cartridge TC mounted upon initial installation is to be 50% and the initial toner filling amount of a replaced toner cartridge TC is to be 100%, the driving time T1 for the dispense motor 73 may be corrected only upon initial installation.

Herein, the exemplary embodiment is described as one in which programs are installed in advance. The programs may be provided by storing them in a storage medium such as a compact disc-read-only memory (CD-ROM). Alternatively, the programs may be downloaded from a server or the like connected to a network, such as a telecommunication line, to a storage in the image forming apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

at least one toner cartridge that is filled with toner and that is replaceable;

a toner supplying unit that supplies the toner from the at least one toner cartridge to a developing device of the image forming apparatus; and a control unit that exerts control in such a manner that, when the at least one toner cartridge is mounted in the image forming apparatus, the toner supplying unit is driven on a basis of an amount of toner with which the at least one toner cartridge which is mounted is filled in advance, wherein T1>T2, where T1 represents a driving time for the toner supplying unit driven on a basis of the amount of toner with which the at least one toner cartridge is filled in advance, the at least one toner cartridge being mounted when the image forming apparatus is initially installed, and T2 represents a driving time for the toner supplying unit driven on a basis of the amount of toner with which the at least one toner cartridge is filled in advance, the at least one toner cartridge being newly mounted when no toner is detected in the image forming apparatus.

2. The image forming apparatus according to claim 1, wherein the at least one toner cartridge includes a first toner cartridge and a second toner cartridge, wherein the first toner cartridge is filled with a first amount of toner in advance and is replaceable, wherein the second toner cartridge is filled with a second amount of toner in advance and is replaceable, the second amount being less than the first amount, wherein the toner supplying unit supplies the toner from the first toner cartridge and the second toner cartridge to the developing device of the image forming apparatus, wherein the control unit exerts control in such a manner that, when the first toner cartridge is mounted in the image forming apparatus, the toner supplying unit is driven on a basis of the first amount of toner with which the first toner cartridge which is mounted is filled in advance, and that, when the second toner cartridge is mounted in the image forming apparatus, the toner supplying unit is driven on a basis of the second amount of toner with which the second toner cartridge which is mounted is filled in advance, and wherein T1>T2>T3, where T1 represents a driving time for the toner supplying unit driven on a basis of the second amount of toner with which the second toner cartridge is filled in advance, the second toner cartridge being mounted when the image forming apparatus is initially installed, T2 represents a driving time for the toner supplying unit driven on a basis of the second amount of toner with which the second toner cartridge is filled in advance, the second toner cartridge being newly mounted when no toner is detected in the image forming apparatus, and T3 represents a driving time for the toner supplying unit driven when an amount of the toner of the first toner cartridge which has been mounted in the image forming apparatus and from which toner has been supplied to the developing device is decreased down to the second amount of toner.

3. The image forming apparatus according to claim 2, wherein the driving time for the toner supplying unit is determined by adding a predetermined driving time to a driving time determined on a basis of an amount of toner with which filling is performed in advance.

4. The image forming apparatus according to claim 3, wherein the driving time determined on a basis of the amount of toner with which filling is performed in advance is determined by multiplying the predetermined driving time by a coefficient selected on a basis of the amount of toner with which filling is performed in advance.

5. The image forming apparatus according to claim 4, wherein the driving time determined on a basis of the amount of toner with which filling is performed in advance is determined in accordance with a plurality of predetermined toner amount classifications.

6. The image forming apparatus according to claim 3, wherein the driving time determined on a basis of the amount of toner with which filling is performed in advance is determined in accordance with a plurality of predetermined toner amount classifications.

7. The image forming apparatus according to claim 2, wherein the driving time determined on a basis of the amount of toner with which filling is performed in advance is determined in accordance with a plurality of predetermined toner amount classifications.

8. The image forming apparatus according to claim 1, wherein the driving time for the toner supplying unit is determined by adding a predetermined driving time to a driving time determined on a basis of an amount of toner with which filling is performed in advance.

9. The image forming apparatus according to claim 8, wherein the driving time determined on a basis of the amount of toner with which filling is performed in advance is determined by multiplying the predetermined driving time by a coefficient selected on a basis of the amount of toner with which filling is performed in advance.

10. The image forming apparatus according to claim 9, wherein the driving time determined on a basis of the amount of toner with which filling is performed in advance is determined in accordance with a plurality of predetermined toner amount classifications.

11. The image forming apparatus according to claim 8, wherein the driving time determined on a basis of the amount of toner with which filling is performed in advance is determined in accordance with a plurality of predetermined toner amount classifications.

12. The image forming apparatus according to claim 1, wherein the driving time determined on a basis of the amount of toner with which filling is performed in advance is determined in accordance with a plurality of predetermined toner amount classifications.

13. A non-transitory computer readable medium storing a program causing a computer to execute a process for an image forming apparatus including a toner cartridge and a toner supplying unit, the toner cartridge being filled with toner and being replaceable, the process comprising:

supplying the toner from the toner cartridge to a developing device of the image forming apparatus by using the toner supplying unit; and when the toner cartridge is mounted in the image forming apparatus, controlling the toner supplying unit in such a manner that T1>T2, where T1 represents a driving time for the toner supplying unit driven on a basis of the amount of toner with which the toner cartridge is filled in advance, the toner cartridge being mounted when the image forming apparatus is initially installed, and T2 represents a driving time for the toner supplying unit driven on a basis of the amount of toner with which the toner cartridge is filled in advance, the toner cartridge being newly mounted when no toner is detected in the image forming apparatus.

14. An image forming method for an image forming apparatus including a toner cartridge and a toner supplying unit, the toner cartridge being filled with toner and being replaceable, the method comprising:

supplying the toner from the toner cartridge to a developing device of the image forming apparatus by using the toner supplying unit; and when the toner cartridge is mounted in the image forming apparatus, controlling the toner supplying unit in such a manner that T1>T2, where T1 represents a driving time for the toner supplying unit driven on a basis of the amount of toner with which the toner cartridge is filled in advance, the toner cartridge being mounted when the image forming apparatus is initially installed, and T2 represents a driving time for the toner supplying unit driven on a basis of the amount of toner with which the toner cartridge is filled in advance, the toner cartridge being newly mounted when no toner is detected in the image forming apparatus.

* * * * *